US008011948B2

(12) United States Patent
Wu

(10) Patent No.: US 8,011,948 B2
(45) Date of Patent: Sep. 6, 2011

(54) ELECTRICAL CONNECTOR ASSEMBLY WTH IMPROVED LATCHING MECHANISM

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/774,722

(22) Filed: May 5, 2010

(65) Prior Publication Data

US 2010/0285682 A1 Nov. 11, 2010

(30) Foreign Application Priority Data

May 6, 2009 (CN) ..... 2009 1 0302108

(51) Int. Cl.
*H01R 13/627* (2006.01)

(52) U.S. Cl. ..... 439/358; 439/76.1

(58) Field of Classification Search ..... 439/76.1, 439/350, 353, 354, 355, 357, 358
See application file for complete search history.

(56) References Cited

U.S. PATENT DOCUMENTS 5,797,771 A * 8/1998 Garside ..... 439/607.46
5,860,826 A 1/1999 Chang
6,991,487 B2 1/2006 Wu
7,303,438 B2 * 12/2007 Dawiedczyk et al. ... 439/607.53
7,410,365 B2 * 8/2008 Wu ..... 439/76.1
7,422,457 B1 9/2008 Wu
2005/0070148 A1 * 3/2005 Zhang ..... 439/358
2007/0155218 A1 * 7/2007 Wu ..... 439/358
2010/0273335 A1 * 10/2010 Wu ..... 439/80
2010/0285682 A1 * 11/2010 Wu ..... 439/357

* cited by examiner

*Primary Examiner* — Ross N Gushi
(74) *Attorney, Agent, or Firm* — Wei Te Chung; Andrew C. Cheng; Ming Chieh Chang

(57) ABSTRACT

An electrical connector assembly (1) for connecting with a cable (7), comprises a metallic housing (2) defining a receiving room (23), a pair of receiving spaces disposed at two sides of the receiving room and a pair of slits formed at two sides of the housing and respectively communicated with the pair of receiving spaces. A printed circuit board (3) is received into the receiving room and has a mating portion (31) extending forwardly from a front surface of the housing. A pair of latches (4) received into the corresponding receiving spaces, each latch having a base portion (41) disposed in the receiving space, an engaging portion (42) formed at a front end thereof and engaged with the housing and a pressing portion (43) extending rearwardly from the base portion and out of the housing, a latching portion (411) extending outwardly from the base portion and passing through the slit for latching with a complementary connector, an elastic portion (412) extending inwardly and rearwardly from the base portion to urge the latching portion extending out of the housing.

20 Claims, 8 Drawing Sheets

ELECTRICAL CONNECTOR ASSEMBLY WTH IMPROVED LATCHING MECHANISM

FIELD OF THE INVENTION

The present invention relates to an electrical connector assembly, and more particularly to an electrical connector assembly used for high-speed transmission.

DESCRIPTION OF PRIOR ART

SFP (Small Form-factor Pluggable), X-SFP and QSFP are all modules for fiber optic transmission or signal transmission. All of the modules are of small size or form factor which is important. The smaller the form factor of the module, the less space taken on a printed circuit board to which it couples. A smaller form factor allows a greater number of modules to be coupled onto a printed circuit board to support additional communication channels. However, the smaller form factor makes it more difficult for a user to handle.

When such a module embedded in a system fails to work, it is desirable to replace it, particularly when other communication channels are supported by other modules. To replace a failed module, it needs to be pluggable into a module receptacle. While, plugging in a new module is usually easy, it is more difficult to remove the failed module because of other components surrounding it. Additionally, a user should not attempt to pull on cables of the module in order to try and remove a failed module or else the user might cause damage thereto.

Therefore, designers developed different solutions to solve above problems accounted by the users, such as disclosed by U.S. Pat. Nos. 6,851,867, 6,749,448, 6,884,097, 6,908,323, 7,052,306, 6,824,416 and 7,090,523. The theories of theses patents are substantially the same, that is each module is received in corresponding cage or module receptacle and comprises a pair of sliders with forward ends engaging with tabs of the cage, and a bail or lever capable of rotating to actuate the sliders linearly to separate forward ends of the sliders from the tabs. The action theory of theses patents successfully solve the problems mentioned above. However, the latch mechanisms disclosed above all need springs to serve as spring back means to actuate the latch mechanisms to return to original positions. Further, the plug modules are arranged side by side to mate with module receptacles. There is little space left for operator to pull bail or levers to separate the modules from the module receptacles. The present invention provides a plug module with an improved latch mechanism operating in a theory different from that of these patents while still successfully solving the problems.

As discussed above, an improved electrical connector assembly overcoming the shortages of existing technology is needed.

SUMMARY OF THE INVENTION

Accordingly, an object of the present invention is to provide an electrical connector assembly with an improved latching mechanism for latching to and releasing from the receptacle connector conveniently, and occupied a smaller space around the electrical connector assembly.

In order to achieve the above-mentioned objects, an electrical connector assembly for connecting with a cable, comprises a metallic housing defining a receiving room, a pair of receiving spaces disposed at two sides of the receiving room and a pair of slits formed at two sides of the housing and respectively communicated with the pair of receiving spaces. A printed circuit board is received into the receiving room and has a mating portion extending forwardly from a front surface of the housing. A pair of latches are received into the corresponding receiving spaces, each latch has a base portion disposed in the receiving space, an engaging portion formed at a front end thereof and engaged with the housing and a pressing portion extending rearwardly from the base portion and out of the housing, a latching portion extending outwardly from the base portion and passing through the slit for latching with a complementary connector, an elastic portion extending inwardly and rearwardly from the base portion to urge the latching portion extending out of the housing.

Other objects, features and advantages of the invention will be apparent from the following detailed description taken in connection with the accompanying drawings.

DETAILED DESCRIPTION OF PREFERRED EMBODIMENTS

Figure 1:
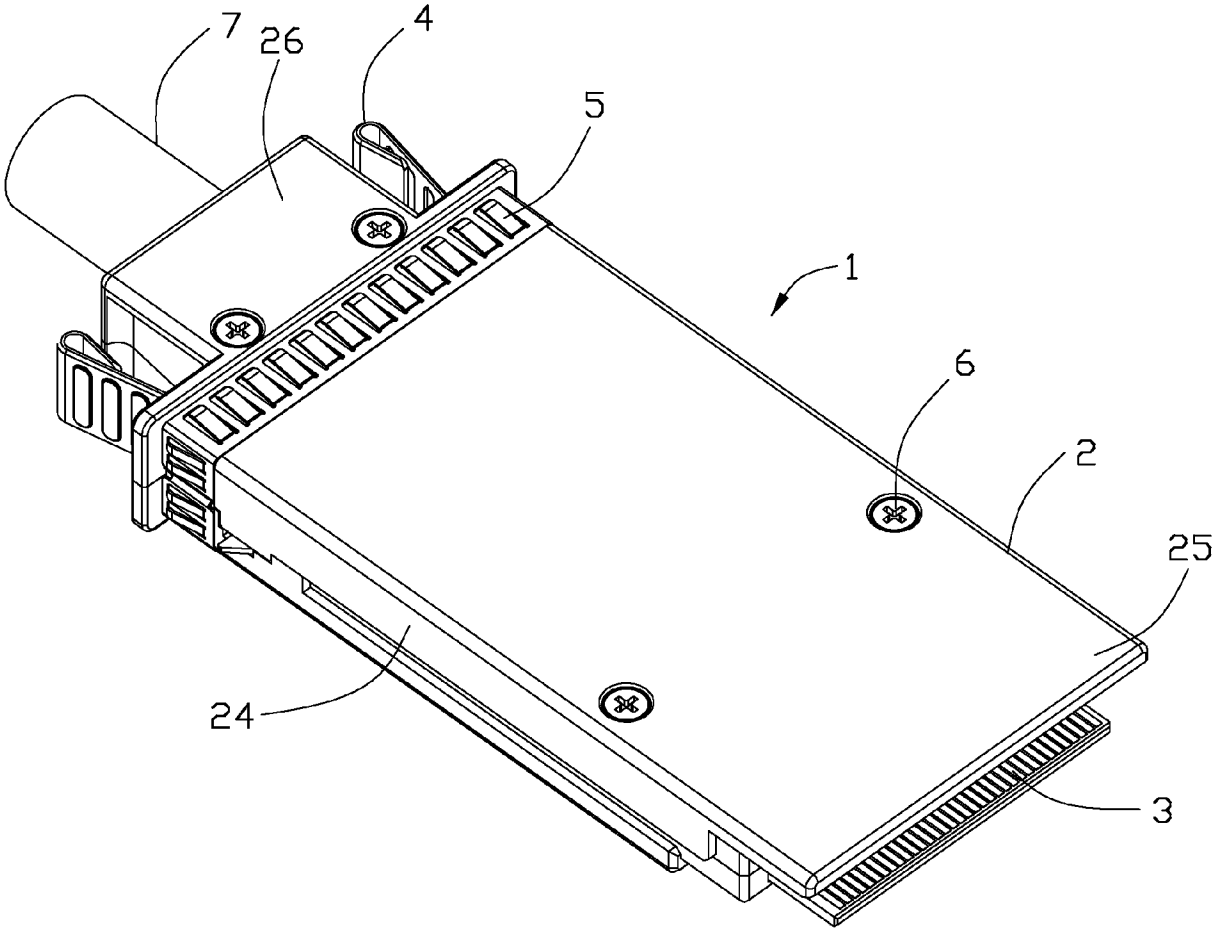
FIG. 1 is a perspective view of an electrical connector assembly in accordance with the present invention connected with a cable.

Reference will now be made to the drawing figures to describe the present invention in detail.

Figure 2:
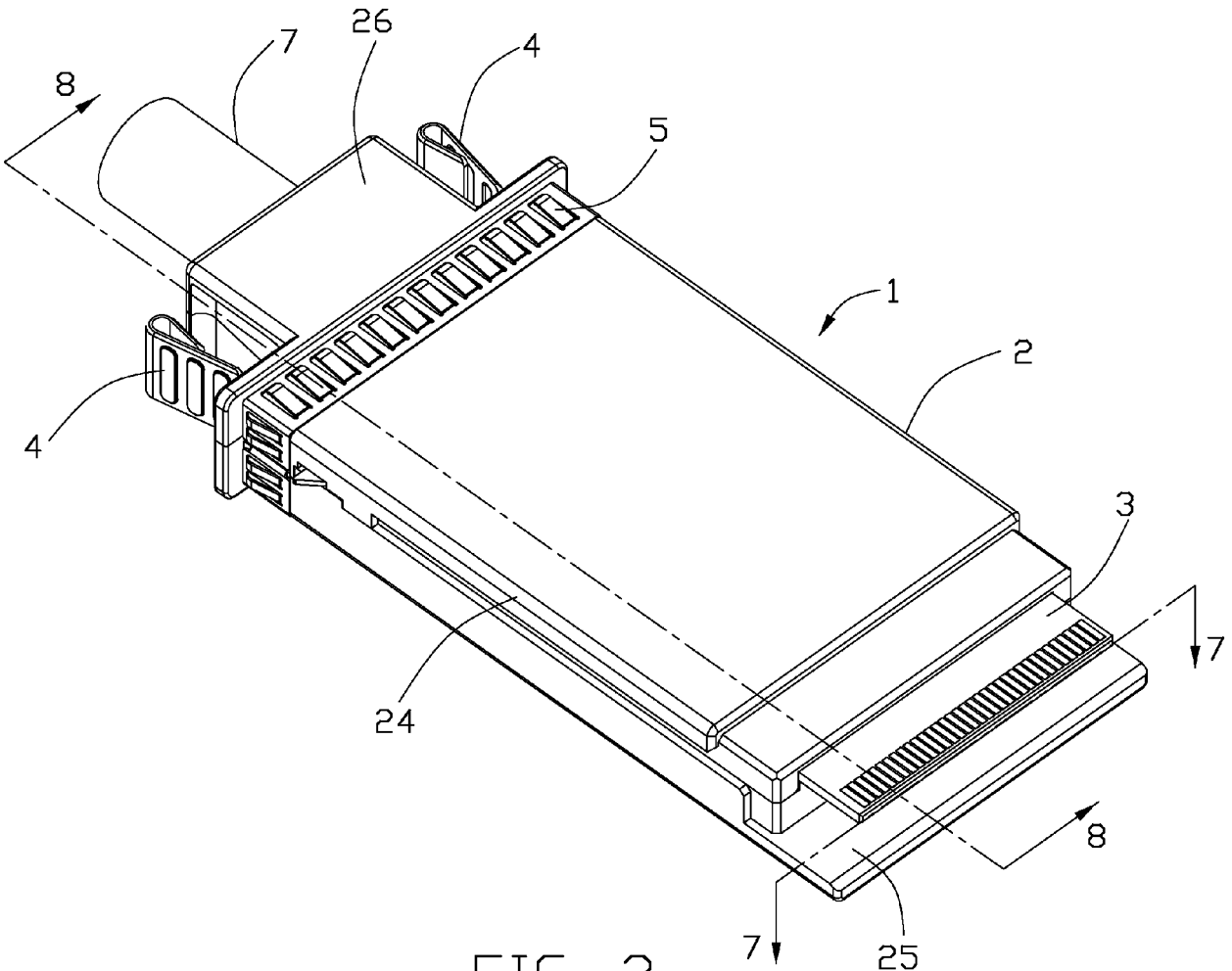
FIG. 2 is an another perspective view of the electrical connector assembly connected with a cable of FIG. 1.
Figure 5:
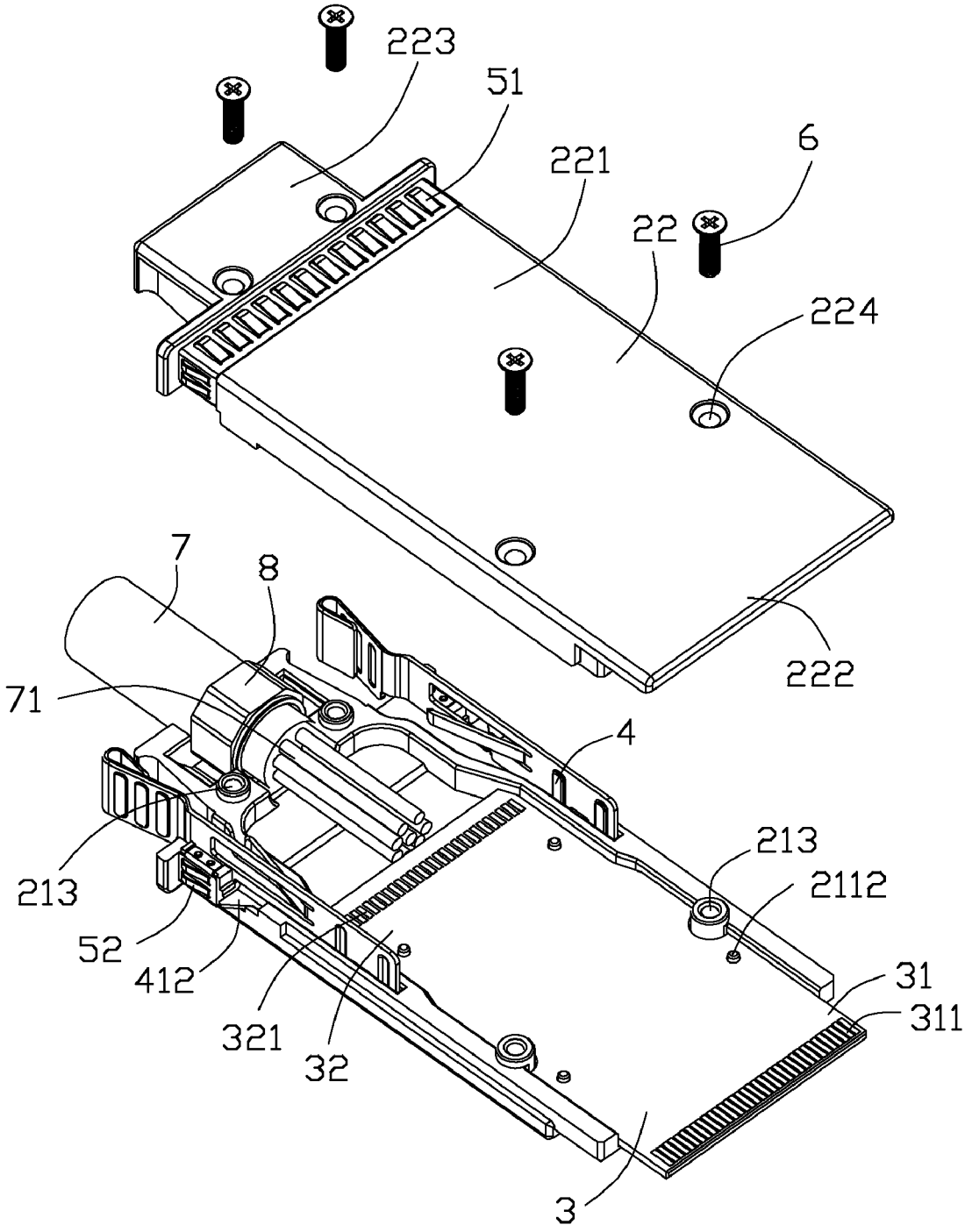
FIG. 5 is a partially assembled view of the electrical connector assembly connected with a cable of FIG. 1.

Referring to FIGS. 1, 2 and 5, an electrical connector assembly 1 in accordance with the present invention for electrically connected with a cable 7 or an optical module (not shown), comprises a metallic housing 2, a printed circuit board 3 disposed in the metallic housing 2, a pair of latches 4 located at two sides of the metallic housing 2 and a gasket 5 surrounding an outer surface of the metallic housing 2. A strain relief 8 is attached to a front end of the cable 7.

Referring to FIGS. 1 to 4 and 8, the metallic housing 2 includes a lower cover 21 and an upper cover 22 assembled to the lower cover 21. The lower cover 21 and upper cover 22 are all die-cast to provide EMI protection. The housing 2 defines a receiving room 23 for receiving a printed circuit board 3 and a front end of the cable 7, a front opening (not figured) for a mating portion 31 of the printed circuit board 3 passing through, and a rear opening (not figured) for the cable 7 entered into the receiving room 23. The front opening and rear opening respectively communicates with the receiving room 23 and allows the receiving room 23 communicating with an exterior. The housing 2 includes a body portion 24, a tongue portion 25 extending forwardly from a front surface of the body portion 24 and a supporting portion 26 extending rearwardly from a rear surface of the body portion 24 for supporting a front end of the cable 7. The supporting portion 26 has a receiving cavity 261 therein for accommodating a front end of the cable 7.

Figure 3:
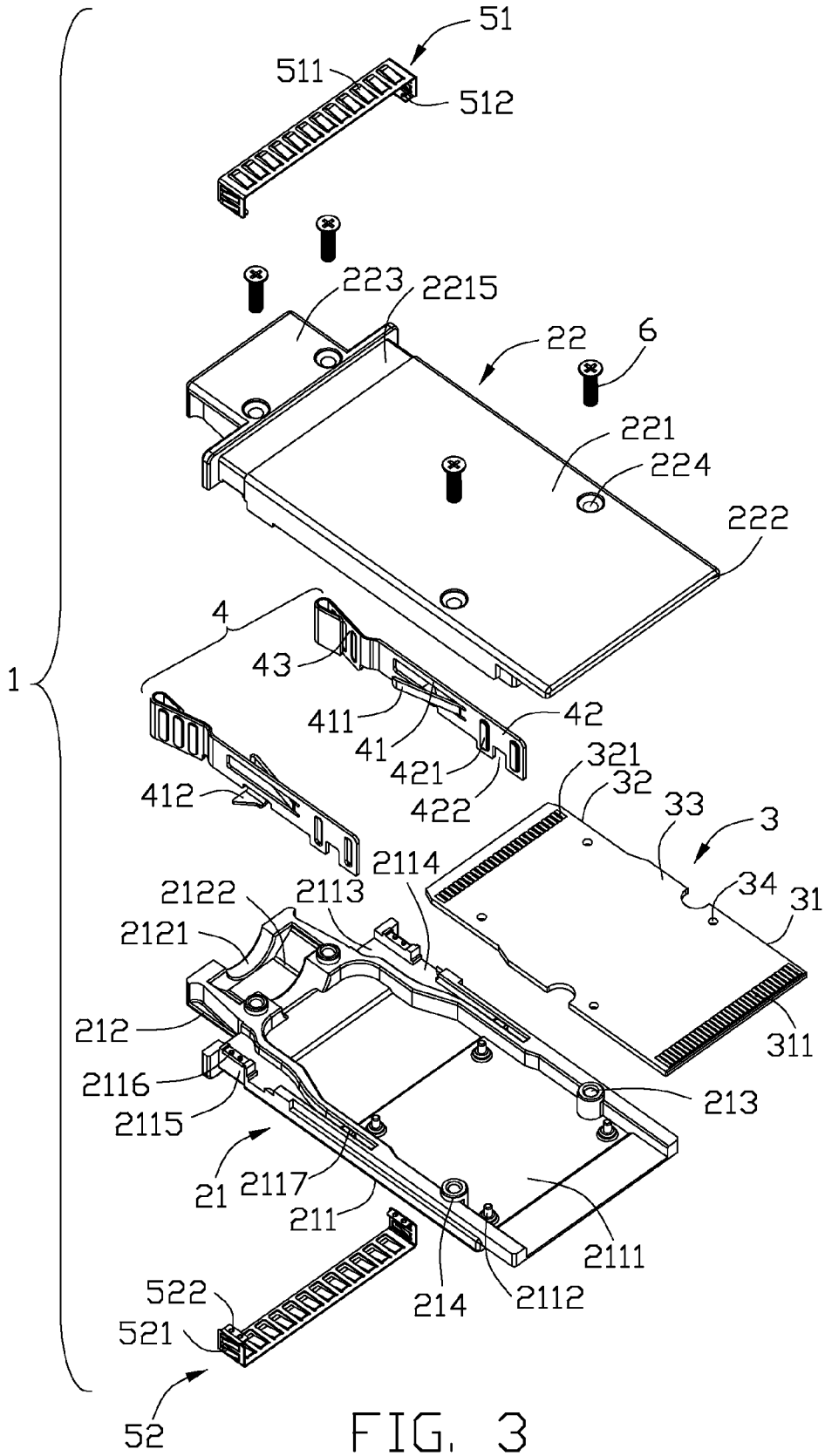
FIG. 3 is an exploded, perspective view of the electrical connector assembly in accordance with the present invention of FIG. 1.
Figure 4:
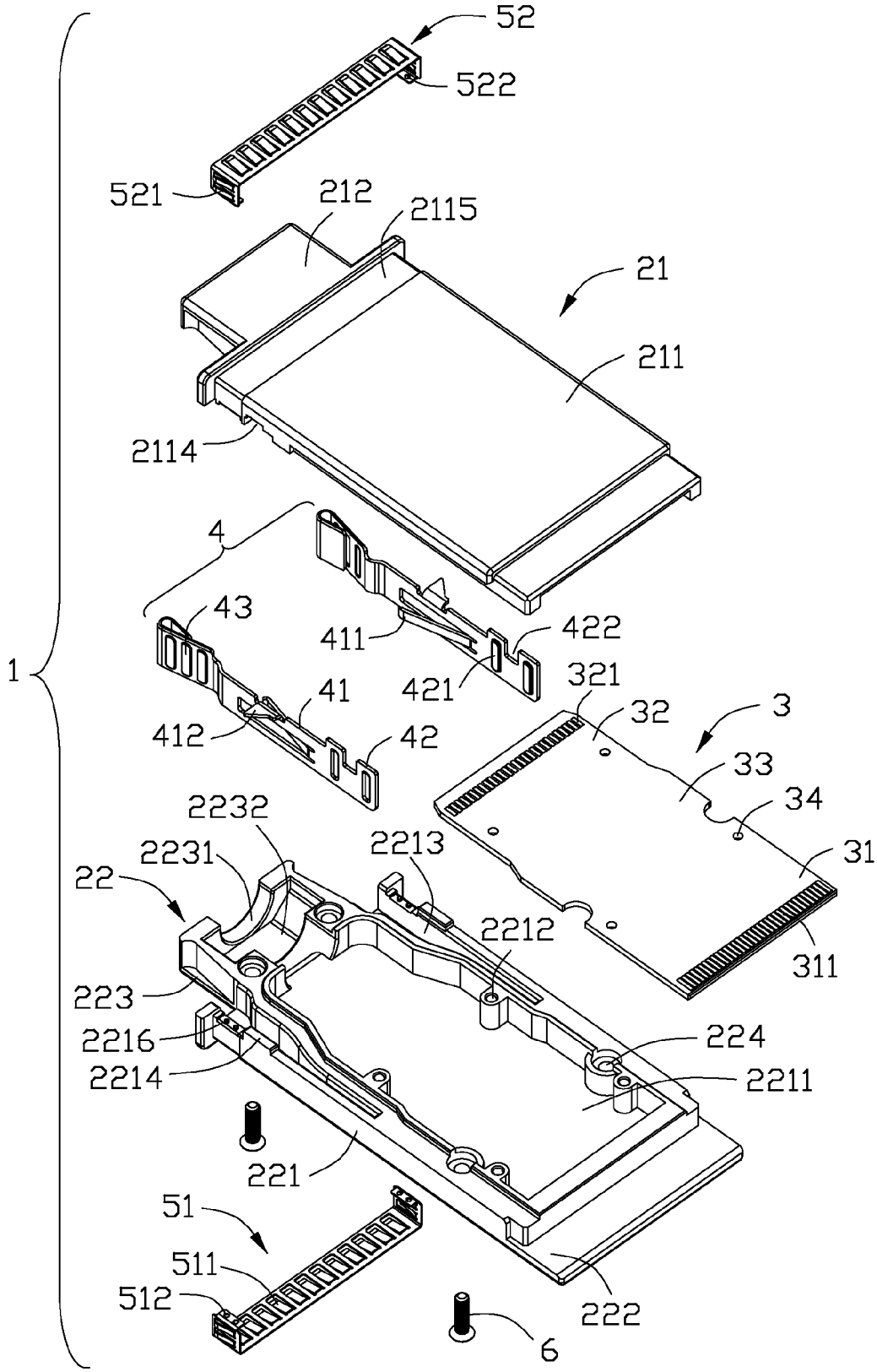
FIG. 4 is an exploded, perspective view of the electrical connector assembly in accordance with the present invention of FIG. 2.

Referring to FIGS. 3 and 4, the lower cover 21 includes a first base section 211 and a first rear section 212 extending rearwardly from a rear surface of the first base section 211. The first base section 211 defines a first recess 2111 extending downwardly from a top surface thereof for a distance and a pair of first channels 2113 located at two sides of the first recess 2111. The pair of first channels 2113 are respectively disposed at a rear and lateral side of the first base section 211 and spaced apart with the first recess 2111 in a widthwise direction. A plurality of positioning posts 2112 are formed on a bottom surface of the first recess 2111. And, a protruding piece 2117 is formed in a front area of each first channel 2113. The first base section 211 defines a pair of cutouts 2114 located at two sides thereof and respectively communicated with the pair of first channels 2113. The first base section 211 defines a first depressed area 2115 formed on an outer surface thereof and adjacent to the first rear section 212. A plurality of protrusions 2116 are formed in the first depressed area 2115. The first rear section 212 defines a first semicircular slot 2121 for supporting the cable 7 and communicated with the first recess 2111 in a front to rear direction. And, a first groove 2122 is formed in the first semicircular slot 2121 for cooperating with a portion of the strain relief 8. A plurality of first receiving holes 213 are formed in the lower cover 21. A circular protruding rib 214 is formed at a top end of each first receiving hole 213.

Figure 7:
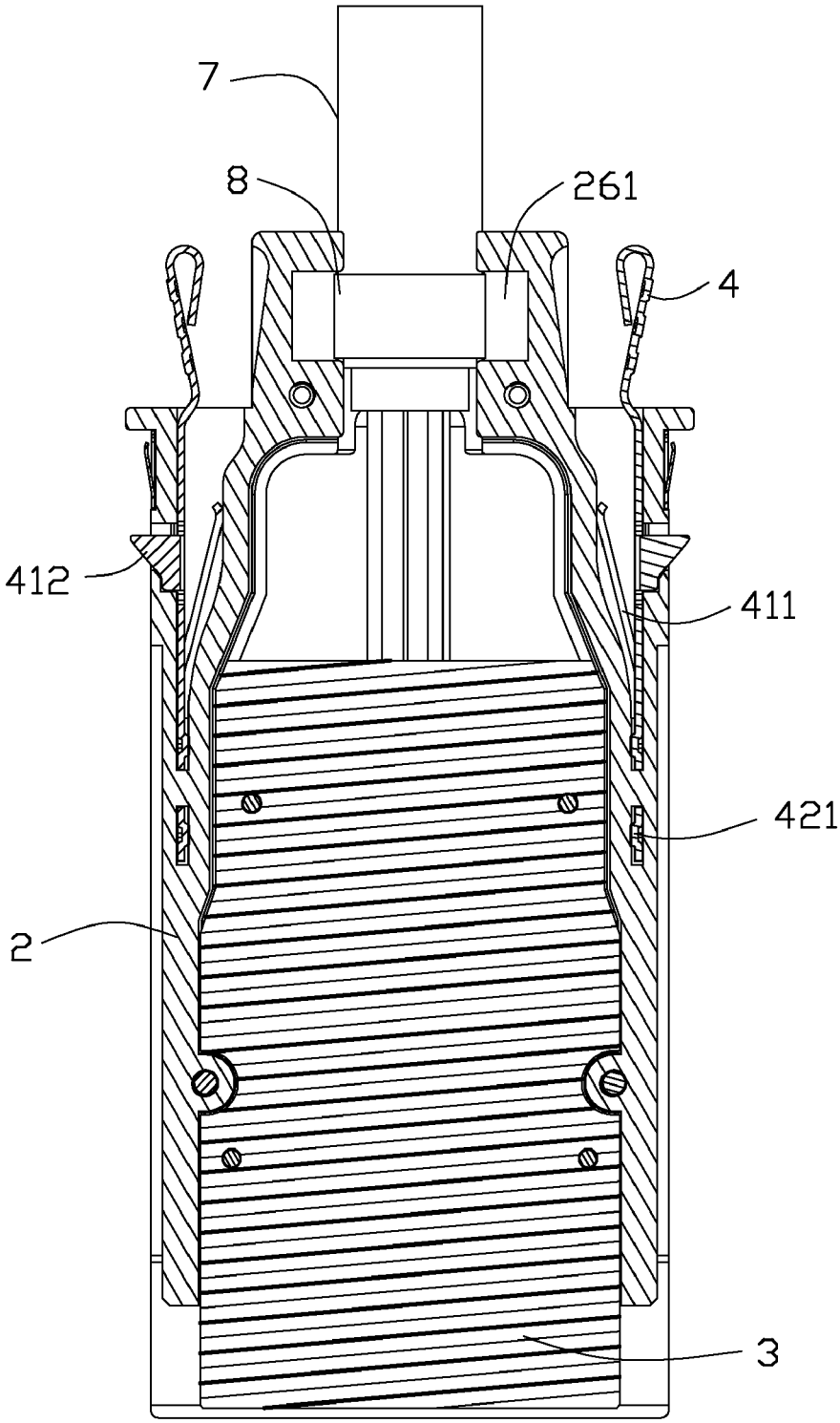
FIG. 7 is a cross-section view taken along line 7-7 of FIG. 2.
Figure 8:
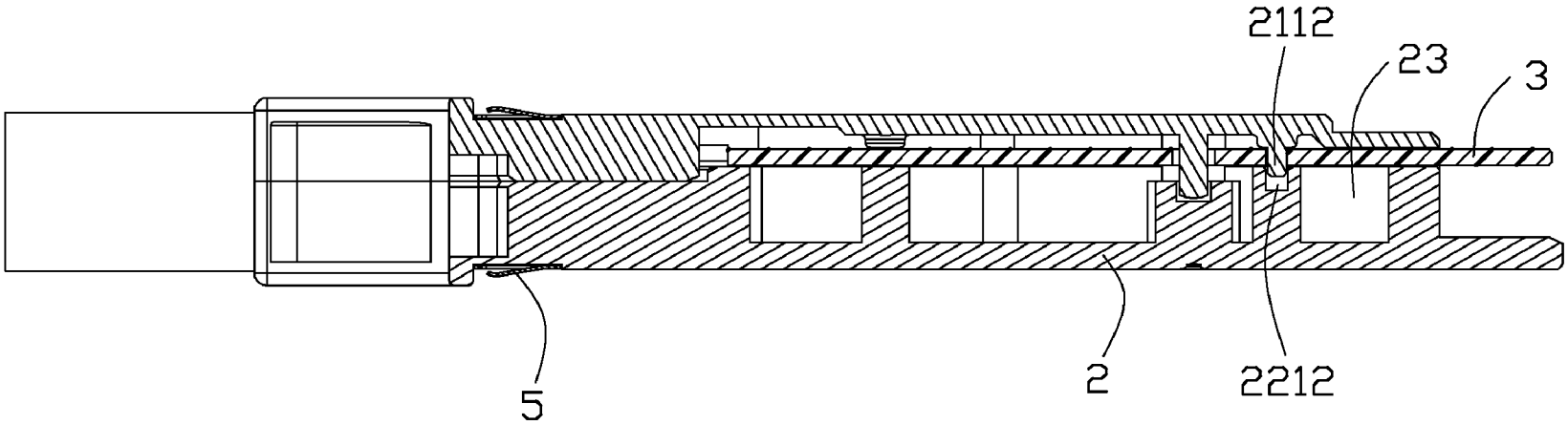
FIG. 8 is a cross-section view taken along line 8-8 of FIG. 2.

Referring to FIGS. 3 to 4 and 7, the upper cover 22 is cooperated with the lower cover 21 and comprises a second base section 221, a tongue section 222 extending forwardly from a front surface of the second base section 221 and a second rear section 223 extending rearwardly from a rear surface of the second base section 221. The upper cover 22 defines a second recess 2211 extending upwardly from a bottom surface of the upper cover 22 and a plurality of second receiving holes 2212 formed on the bottom surface of the upper cover 22. The second recess 2211 is corresponding to the first recess 2111 in an up to down direction. The plurality of positioning posts 2112 of the lower cover 21 are corresponding to the second receiving holes 2212 and can be received into the second receiving holes 2212. In addition, the upper cover 22 further defines a plurality through holes 224 extending from a bottom surface to a top surface thereof and corresponding to the first receiving holes 213 of the lower cover 21 in a up to down direction. Each circular protruding rib 214 of lower cover 21 can be received into the through hole 224. The upper cover 22 also defines a pair of second channels 2213 formed on a bottom surface thereof and located at two sides of the second recess 2211. The pair of second channels 2213 are also corresponding to the pair of first channels 2113 of the lower cover 21 in an up to down direction. It should be noted that the protruding piece 2117 of the lower cover 21 also can be defined in each second channel 2213. The printed circuit board 3 can be received into a room formed by the first and second recess 2111, 2211. And the pair of latches 4 can be respectively disposed into a pair of receiving spaces (not figured) of the metallic housing 2. Each receiving space is formed by the pair of first and second channels 2113, 2213. The upper cover 22 defines a pair of extrusive pieces 2214 formed on two sides of the bottom surface of the second base section 221 thereof The pair of extrusive pieces 2214 can be cooperated with the pair of the cutouts 2114 of the lower cover 21. The second base section 221 of the upper cover 22 defines a second depressed area 2215 formed on an outer surface thereof and adjacent to the second rear section 223. A plurality of protrusions 2216 are formed in the second depressed area 2215. The second rear section 223 defines a second semicircular slot 2231 for supporting a front end cable 7 and communicated with the second recess 2211 in a front to rear direction. And, a second groove 2232 is formed in the second semicircular slot 2231 for cooperating with a portion of the strain relief 8. The receiving cavity 261 of the supporting portion 26 of the metallic housing is formed by the first and second semicircular slots 2121, 2231 and grooves 2122, 2232 when the lower cover 21 and the upper cover 22 are assembled with each other.

Referring to FIGS. 3 to 5, the printed circuit board 3 disposed in the metallic housing 2 defines a mating portion 31 with a plurality of conductive pads 311 thereon, a terminating portion 32 opposite to the mating portion 31 and with a plurality of conductive pads 321 for terminating to a plurality of cables 4 and a connecting portion 33 connected with the mating portion 31 and the terminating portion 32. The conductive pads 311, 321 are respectively arranged on opposite upper and lower surfaces of the mating portion 31 and the terminating portion 32 of the printed circuit board 3 in a transversal direction. The printed circuit board 3 defines four positioning holes 34 corresponding to the positioning posts 2112 in a vertical direction and can be cooperated with the positioning posts 2112 of the lower cover 21.

Referring to FIGS. 3 to 5, the pair of latches 4 are formed at two sides of the housing 2. A latching mechanism assembled to the housing 2 is formed by pair of the latches 4. Each latch 4 is stamped and formed from a metallic plate and comprises a base portion 41, a pressing portion 43 extending rearwardly from a rear end of the base portion 41 and an engaging portion 42 formed at a front end of the latch 4. The latch 4 further defines an inclined elastic portion 411 extending inwardly and rearwardly from an inner side of the base portion 41 and a latching portion 412 extending outwardly for latching with the complementary connector (not shown). The engaging portion 42 of each latch 4 defines two projections 421 formed on an inner surface thereof and a gap 422 formed on a bottom side thereof for receiving the protruding piece 2117 formed in the first channel 2113. In another embodiment, the gap 422 can be also formed on an upper side thereof for cooperating with a protruding piece formed in the second channel 2213. The pressing portion 43 defines a plurality of projections (not figured) on an outer surface thereof for the operator's easily holding.

Referring to FIGS. 3 to 6 and 8, the gasket 5 is a rectangular frame and stamped from a metal sheet. The gasket 5 is used for reducing the Electro Magnetic Interference (EMI) in the signal transmission of electrical connector assembly 1. The gasket 5 has a first piece 51 and a second piece 52 having a same structure with the first piece 51. The first piece 51 is received into the second depressed area 2215 and engaged with the upper cover 22. The second piece 52 is received into the first depressed area 2115 and engaged with the lower cover 21. The first piece 51 defines a plurality of holes 512 at two sides thereof for cooperating with a plurality of protrusions 2216 formed in the second depressed area 2215 to achieve an engagement between the first piece 51 and the upper cover 22. The second piece 52 also defines a plurality of holes 522 at two sides thereof for cooperating with a plurality of protrusions 2116 formed in the first depressed area 2115 to achieve an engagement between the second piece 52 and the lower cover 21. The first and second pieces 51, 52 are respectively defines a plurality of spring tabs 511, 512 thereof The first and second spring tabs 511, 512 may elastically engage with a conductive panel to which the complementary connector is mounted for grounding and reducing EMI.

Referring to FIG. 2, a plurality of screws 6 are assembled to the housing 2 for interlocking the lower cover 21 and upper cover 22.

Figure 6:
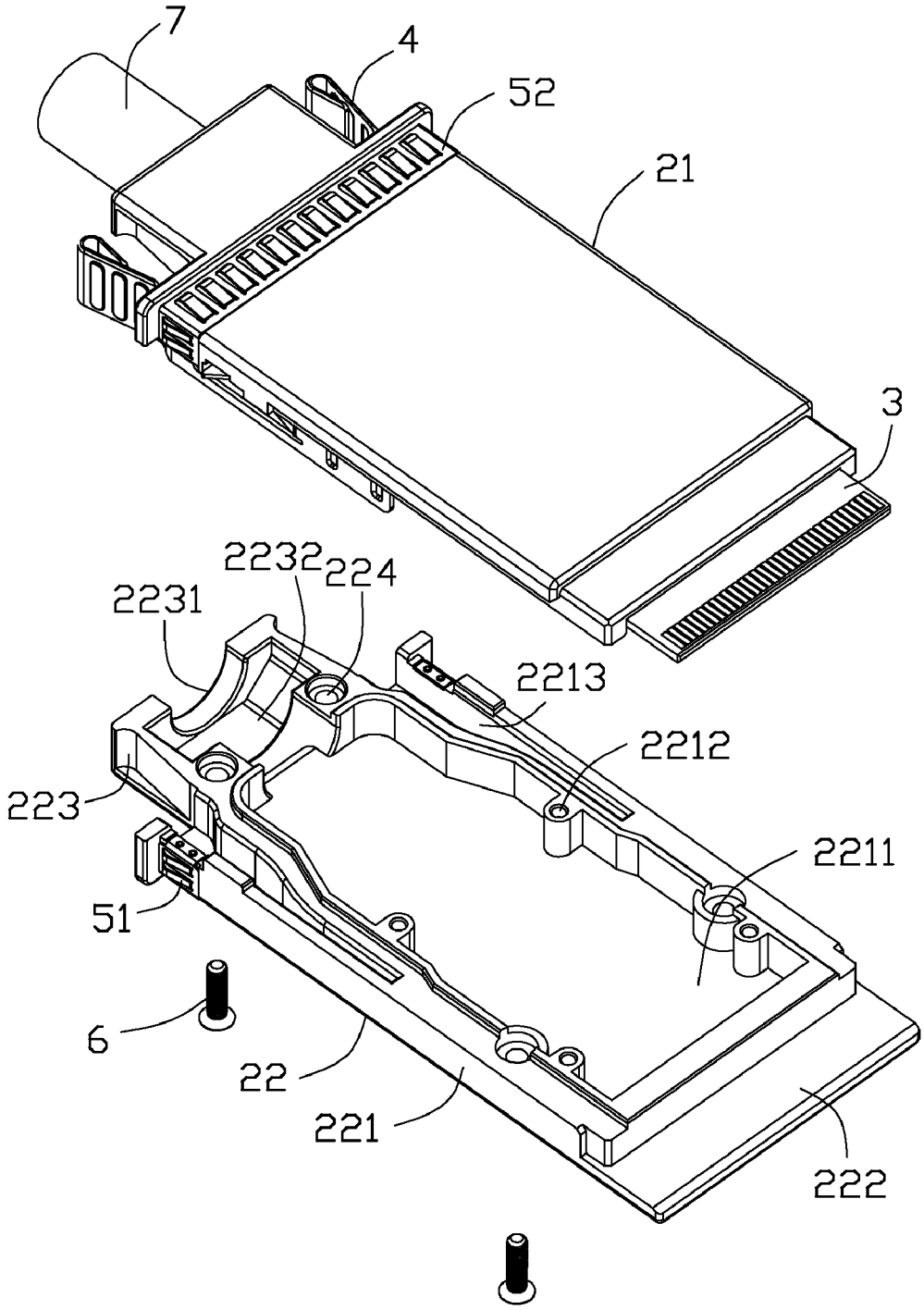
FIG. 6 is a partially assembled view of the electrical connector assembly connected with a cable of FIG. 2.

Referring to FIGS. 5 to 7, the cable 7 has a plurality of conductive wires 71 and an insulative layer 72 surrounding the plurality of conductive wires 71. The conductive wires 71 can be soldered to the terminating portion 32 of the printed circuit board 3. A strain relief 8 is attached to a front end of the cable 7 and surrounded the insulative layer 72 of the cable 7.

Referring to FIGS. 1 to 8, the assembling process of the electrical connector assembly 100 made in according to the present invention starts from assembling the first and second pieces 51, 52 of gasket 5 to the housing 2. In this case, the first piece 51 of gasket 5 is received into the second depressed area 2215 of upper cover 22 and engaged with the upper cover 22. The second piece 52 of gasket 5 is received into the first depressed area 2115 of the lower cover 21 and engaged with the lower cover 21.

After the first and second pieces 51, 52 of gasket 5 are respectively assembled to the upper and lower covers 22, 21 of the housing 2, then soldering the conductive wires 71 of the cable 7 to the terminating portion 32 of the printed circuit board 3 to achieve an electrically and mechanically connection between the printed circuit board 3 and the cable 7. Then, assembling the printed circuit board 3 and the cable 7 together to the lower cover 21. As a result, the positioning posts 2112 of the lower cover 21 pass through the corresponding positioning holes 34 of the printed circuit board 3, thus, the printed circuit board 3 and the lower cover 21 are engaged with each other. The mating portion 31 of the printed circuit board 3 extends forwardly from a front surface of the lower cover 21. In addition, a bottom portion of the front end of the cable 7 is received into the first semicircular slot 2121, and the strain relief 8 surrounding the cable 7 is disposed into the first groove 2122. Thus, the cable 7 is preliminary positioned in the lower cover 21.

After the printed circuit board 3 and the cable 7 are assembled to the lower cover 21, then assembling the pair of latches 4 to the pair of first channels 2113 of the lower cover 21. In this case, the bottom side of the base portion 41 and the engaging portion 42 of each latch 4 is disposed in the first channel 2113. And the gap 422 of the latch 4 is cooperated with the protruding piece 2117 formed in the first channel 2113 to make the latch 4 positioned to the lower cover 21 in a front to rear direction. Two projections 421 formed on an inner surface of the latch 4 are interferential with an inner surface of the first channels 2113 to make the latch 4 engaged to the lower cover 21. The latching portion 412 of each latch 4 extends laterally to an exterior through the cutout 2114 of the lower cover 21. The pressing portion 43 extends out of the first channels 2113 in a front to rear direction and disposed adjacent to the first rear section 212 of the lower cover 21 in a transversal direction.

After the pair of latches 4 are assembled to the lower cover 21, then assembling the upper cover 22 to the lower cover 21, the bottom surface of the upper cover 22 is attached to the top surface of the lower cover 21 to form the housing 2. As a result, each circular rib 214 of the lower cover 21 is received into the through holes 224 of the upper cover 22. The pair of extrusive pieces 2214 of the second base section 221 of the upper cover 22 are received into the corresponding pair of cutouts 2114 of the first base section 211 of the lower cover 21. It should be noted that the pair of extrusive pieces 2214 are not full filled into the pair of cutouts 2114, thus, so a pair of slits (not figured) are formed at two sides of the housing 2 when the lower cover 21 and the upper cover 22 assembled with each other for the latching portions 412 of the pair of latches 4 extending outwardly to an exterior. After the upper cover 22 is assembled to the lower cover 21, the upper cover 22 and the lower cover 21 are positioned with each other in a longitudinal and transversal direction. In addition, a top side of the engaging portion 42 and the base portion 41 of each latch 4 is received into each second channel 2213 of the upper cover 22. Two pressing portions 43 of the pair of latches 4 are disposed at two sides of the first and second rear sections 212, 223. A top side of the front end of the cable 7 is received into the second semicircular slot 2231 of the upper cover 22. A top side of the strain relief 8 is received into the second groove 2232 of the upper cover 22. The tongue section 222 of the upper cover 22 is disposed on a top side of the mating portion 31 of the printed circuit board 3 and spaced apart with the mating portion 31 of the printed circuit board 3.

Finally, assembling four screws (not shown) to the lower cover 21 and the upper cover 22 in an up to down direction to engage the upper cover 22 to the lower cover 21. Thus, the housing 2 is formed by the lower cover 21 and the upper cover 22. It should be noted that the receiving room 23 is formed by the first and second recess 2111, 2211 and first and second semicircular slots 2121, 2231. The body portion 24 of the housing 2 is formed by the first and second base section 211, 221 of the lower cover 21 and the upper cover 22. The supporting portion 26 of the housing 2 is formed by the first and second rear section 212, 223. The tongue portion 25 of the housing 2 is defined by the tongue section 222 of the upper cover 22. The printed circuit board 3 is disposed in the receiving room 23 and has a mating portion 31 extending forwardly from a front surface of the housing 2 and out of the receiving room 23. A front end of the end of the cable 7 extends into the receiving room 23 and electrically connects with print circuit board 3. After the above assembling steps, the entire process of assembling the cable connector assembly 1 connected with the cable 7 is finished.

Obviously, as the pair of latches 4 disposed at two sides of the housing 2, so the operating space is formed at two sides of the supporting portion 26 of the housing 2. Thus, the operator has enough operating space to operate the pair of the latches 4. In addition, the pair of latches 4 are simple and convenient to manufacture.

When the electrical connector assembly 1 is needed to mate with the complementary connector, the operator only exerts an inward force to the two pressing portions 43 of the pair of latches 4. Thus, the latching portions 412 of the pair of latches 4 will be moved inwardly and received into the pair of receiving space, the free end of inclined elastic portion 411 will attach to an inner surface of the receiving space. In addition, as the supporting portion 26 existed, a further inward movement of the pressing portion 43 will be limited. When the electrical connector assembly 100 is fully mated with the complementary connector, the operator can release the two pressing portions 43 of the pair of latches 4. As a result, each latch 4 will be resumed to an original state through an elastic outward force, the latching portion 412 will extend to an exterior and lock with the complementary connector. It should be noted that the elastic outward force is an counterforce from an inner structure of the housing 2 exerted to the elastic portion 412 of the latch 4. If the electrical connector assembly 1 will be removed from the complementary connector, the operator exerts an inward force to the two pressing portions 43 of the pair of latches 4, then pulls the electrical connector assembly out of the complementary connector.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. An electrical connector assembly for connecting with a cable, comprising:

a metallic housing defining a receiving room, a pair of receiving spaces disposed at two sides of the receiving room and a pair of slits formed at two sides of the housing and respectively communicated with the pair of receiving spaces;

a printed circuit board received into the receiving room and having a mating portion extending forwardly from a front surface of the housing;

a pair of latches received into the corresponding receiving spaces, each latch having a base portion disposed in the receiving space, an engaging portion formed at a front end thereof and engaged with the housing and a pressing portion extending rearwardly from the base portion and out of the housing, a latching portion extending outwardly from the base portion and passing through the slit for latching with a complementary connector, an elastic portion extending inwardly and rearwardly from the base portion to urge the latching portion to extend out of the housing.

2. The electrical connector assembly as recited in claim 1, wherein the housing comprises a body portion, a tongue portion extending forwardly from a front surface of the body portion and a supporting portion extending rearwardly from a rear surface of the body portion.

3. The electrical connector assembly as recited in claim 1, wherein the housing comprises a lower cover and an upper cover assembled to the lower cover.

4. The electrical connector assembly as recited in claim 3, wherein the electrical connector assembly further comprises a gasket defining a first piece and a second piece respectively surrounding the upper and lower covers.

5. The electrical connector assembly as recited in claim 3, wherein the lower cover defines a plurality of positioning posts passing through the printed circuit board and received into corresponding receiving holes formed in the upper cover.

6. The electrical connector assembly as recited in claim 3, wherein the lower cover defines a first recess and a pair of first channels disposed at two sides of the first recess, a protruding piece is formed in each first channel, and the engaging portion of the latch defines a gap cooperated with the protruding piece.

7. The electrical connector assembly as recited in claim 1, wherein the printed circuit board further defines a terminating portion and a connecting portion connected with the mating portion and the terminating portion.

8. The electrical connector assembly as recited in claim 1, the electrical connector assembly further defines a plurality of screws to engage the upper cover and the lower cover together.

9. An electrical connector assembly, comprising:

a metallic housing comprising a pair of receiving spaces therein extending forwardly from a rear surface of the housing and a receiving room extending from the rear surface of the housing to a front surface of the housing and disposed between the pair of the receiving spaces in a transversal direction, and a pair of slits formed at two sides of the housing and respectively communicated with the pair of receiving spaces;

a printed circuit board disposed in the receiving room and engaged with the housing;

a pair of latches assembled to the housing, each latch defining a base portion disposed in the receiving space, a pressing portion formed at a rear end of the latch and extending out of the housing, an engaging portion formed at a front end of the latch and engaged with the housing, and a latching portion extending outwardly and passing through the corresponding slit and an elastic portion extending inwardly and rearwardly for providing a counterforce to itself when the pair of latches are being pressed inwardly.

10. The electrical connector assembly as recited in claim 9, wherein a protruding piece is formed in each receiving space, each latch defines a gap cooperated with the protruding piece.

11. The electrical connector assembly as recited in claim 9, wherein the electrical connector assembly further defines a gasket surrounding the housing.

12. The electrical connector assembly as recited in claim 9, wherein the housing defines a tongue portion at a front end thereof, the printed circuit board has a mating portion paralleled and spaced apart with tongue portion in a vertical direction.

13. The electrical connector assembly as recited in claim 9, wherein the housing includes a lower cover and an upper cover engaged with other.

14. The electrical connector assembly as recited in claim 13, wherein the electrical connector assembly further comprises a plurality of screws to engage the upper cover to the lower cover.

15. The electrical connector assembly as recited in claim 13, wherein the lower cover defines a plurality of positioning posts passing through the printed circuit board and received into corresponding receiving holes formed in the upper cover.

16. An electrical connector assembly comprising:

an exterior housing essentially including upper and lower halves assembled together to form a body portion defining a PCB (Printed Circuit Board) receiving room therebewteen in a vertical direction;

a pair of receiving spaces located by two sides of a rear portion of the receiving room;

the housing further defining a support portion located behind the body portion with a flange portion therebetween in a front-to-back direction perpendicular to said vertical direction;

a printed circuit board disposed in the PCB receiving room;

a pair of latches received in the corresponding receiving space with corresponding latching portions extending outwardly and laterally for latching to a complementary connector, and pressing portions for manual operation;

a metallic gasket having plural outwardly extending resilient tangs thereon and surrounding a rear region of the body portion essentially intimately in front of the flange while the pressing portions are exposed intimately behind the flange and by two sides of the support portion.

17. The electrical connector assembly as claimed in claim 16, wherein said gasket includes upper and lower pieces each grasping the corresponding upper and lower halves, respectively.

18. The electrical connector assembly as claimed in claim 17, wherein said upper and lower pieces have securing sections located between an interface of said upper half and the lower half so as to be reliably secured to the body portion without withdrawal once said upper half and said lower half is assembled together.

19. The electrical connector assembly as claimed in claim 16, wherein a pair of screws fasten the body portion together, and another pair of screws fasten the support portion together.

20. The electrical connector assembly as claimed in claim 16, wherein each of said latches is made from sheet metal and to form a final configuration via stamping and forming.

* * * * *